US010184767B2

(12) United States Patent
Daebelliehn et al.

(10) Patent No.: US 10,184,767 B2
(45) Date of Patent: Jan. 22, 2019

(54) METHOD FOR FORMING FRAGMENT WRAP OF A FRAGMENTATION STRUCTURE

(71) Applicant: Aerojet Rocketdyne, Inc., Sacramento, CA (US)

(72) Inventors: Roderick Daebelliehn, Folsom, CA (US); Patrick A. Chastain, Rancho Cordova, CA (US)

(73) Assignee: AEROJET ROCKETDYNE, INC., Rancho Cordova, CA (US)

( * ) Notice: Subject to any disclaimer, the term of this patent is extended or adjusted under 35 U.S.C. 154(b) by 131 days.

(21) Appl. No.: 15/194,685

(22) Filed: Jun. 28, 2016

(65) Prior Publication Data

US 2016/0377398 A1 Dec. 29, 2016

Related U.S. Application Data

(60) Provisional application No. 62/185,699, filed on Jun. 28, 2015.

(51) Int. Cl.

| | |
|---|---|
| ***F42B 12/26*** | (2006.01) |
| ***B21D 53/00*** | (2006.01) |
| ***F42B 33/00*** | (2006.01) |
| ***F42B 12/32*** | (2006.01) |

(52) U.S. Cl.

CPC ..... *F42B 33/00* (2013.01); *B21D 53/00* (2013.01); *F42B 12/26* (2013.01); *F42B 12/32* (2013.01); *Y10T 29/4981* (2015.01)

(58) Field of Classification Search

CPC ..... F42B 33/00; F42B 33/001; F42B 12/26; F42B 12/32; F42B 12/22; Y10T 29/4981; B21D 53/00

See application file for complete search history.

(56) References Cited

U.S. PATENT DOCUMENTS

| | | | | |
|---|---|---|---|---|
| 5,313,890 A * | 5/1994 | Cuadros | F42B 12/32 102/393 |
| 9,291,437 B2 | 3/2016 | Bonnstetter et al. | |
| 2005/0087088 A1 * | 4/2005 | Lacy | F42B 12/24 102/495 |

* cited by examiner

*Primary Examiner* — Jermie Cozart
(74) *Attorney, Agent, or Firm* — Joel G Landau

(57) ABSTRACT

A method includes forming at least one fragment wrap of a fragmentation structure by providing at least one flexible fragment strand that includes a plurality of discrete fragments held together in a pattern by a flexible media, and applying the at least one flexible fragment strand around a core piece to form the at least one fragment wrap.

18 Claims, 3 Drawing Sheets

METHOD FOR FORMING FRAGMENT WRAP OF A FRAGMENTATION STRUCTURE

CROSS-REFERENCE TO RELATED APPLICATION

The present disclosure claims priority to U.S. Provisional Patent Application No. 62/185,699, filed Jun. 28, 2015.

BACKGROUND

Fragmentation structures, such as fragmentation warheads, mines, etc., are employed to disperse fragments over a target area. In simple form, fragmentation structures may utilize natural fragmentation of a casing of the structure. Natural fragmentation often produces fragments of varying size with varying explosion dispersion patterns. Other fragmentation structures may have a case that is scored or a composite case that has prefabricated molded-in fragments in effort to control fragment size and explosion dispersion pattern.

SUMMARY

A method according to an example of the present disclosure includes forming at least one fragment wrap for a fragmentation structure by providing at least one flexible fragment strand that includes a plurality of discrete fragments held together in a pattern by a flexible media, and applying at least one flexible fragment strand around a core piece to form the at least one fragment wrap.

In a further embodiment of any of the foregoing embodiments, the fragment wrap partially covers the core piece.

In a further embodiment of any of the foregoing embodiments, the fragment wrap fully covers the core piece.

In a further embodiment of any of the foregoing embodiments, the applying at least one flexible fragment strand includes applying a first flexible fragment strand around the core piece followed by applying a second flexible fragment strand on the first flexible fragment strand.

In a further embodiment of any of the foregoing embodiments, the second flexible fragment strand fits partially or fully congruently with the first flexible fragment strand.

In a further embodiment of any of the foregoing embodiments, the flexible media encapsulates the fragments.

In a further embodiment of any of the foregoing embodiments, the discrete fragments are bonded to the flexible media.

In a further embodiment of any of the foregoing embodiments, the pattern is a single file line arrangement of the discrete fragments.

In a further embodiment of any of the foregoing embodiments, the pattern comprises multiple elongated rows of the discrete fragments.

In a further embodiment of any of the foregoing embodiments, the pattern comprises multiple columns of the discrete fragments.

In a further embodiment of any of the foregoing embodiments, the flexible media comprises a flexible sleeve that circumscribes the discrete fragments.

In a further embodiment of any of the foregoing embodiments, the applying of at least one flexible fragment strand includes winding the flexible fragment strand around the core piece.

A further embodiment of any of the foregoing embodiments includes applying a plurality of flexible fragment strands around the core piece simultaneously.

A further embodiment of any of the foregoing embodiments includes applying a potting material to the at least one fragment wrap.

In a further embodiment of any of the foregoing embodiments, the discrete fragments comprise dissimilar geometric shapes.

A method according to an example of the present disclosure includes forming a fragment strand for at least one fragment wrap of a fragmentation structure by arranging a plurality of discrete fragments in a pattern, and combining the discrete fragments and a flexible media. The flexible media holds the discrete fragments together in the pattern.

In a further embodiment of any of the foregoing embodiments, the combining includes applying the flexible media to the discrete fragments.

In a further embodiment of any of the foregoing embodiments, the arranging includes arranging the discrete fragments into at least one elongated row.

In a further embodiment of any of the foregoing embodiments, the arranging includes arranging the discrete fragments into multiple columns.

In a further embodiment of any of the foregoing embodiments, the flexible media comprises a flexible sleeve, and the applying includes placing the discrete fragments into the flexible sleeve.

BRIEF DESCRIPTION OF THE DRAWINGS

The various features and advantages of the present disclosure will become apparent to those skilled in the art from the following detailed description. The drawings that accompany the detailed description can be briefly described as follows.

DETAILED DESCRIPTION

Figure 1:
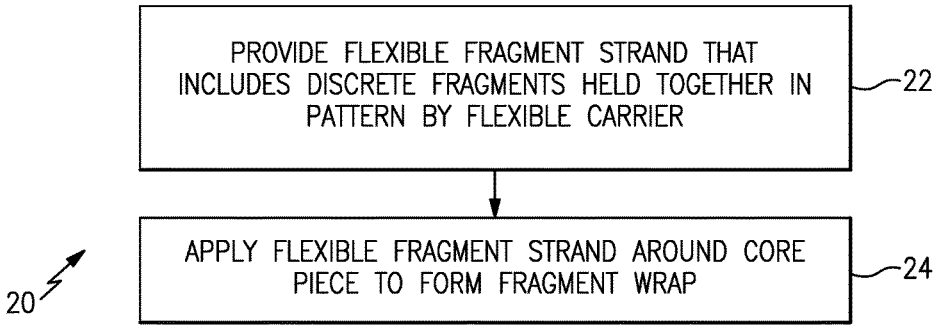
FIG. 1 illustrates an example method of forming at least one fragment wrap of a fragmentation structure.

FIG. 1 illustrates an example method 20 for forming at least one fragment layer of a fragmentation structure. As will be appreciated, the type of fragmentation structure is not particularly limited and may be, but is not limited to, a warhead, a mine, a firearm projectile, a mortar round, a rocket, etc. In this regard, the fragmentation structure may generally include a casing with the fragment layer or layers arranged around an explosive. As will be appreciated, the fragmentation structure may include additional components according to the particular end use, such as but not limited to, detonators and control electronics.

The method 20 generally includes steps 22 and 24, which, although presented and described separately, may be fully or partially combined. Step 22 includes providing at least one flexible fragment strand. The flexible fragment strand is generally elongated and includes a plurality of discrete fragments that are held together in a pattern by a flexible media. The flexible fragment strand or strands may be provided in step 22 as a prefabricated strand or by fabricating the flexible fragment strand from initially separate starting materials. Step 24 then includes applying the flexible fragment strand around a core piece to form a fragment wrap.

Figure 2:
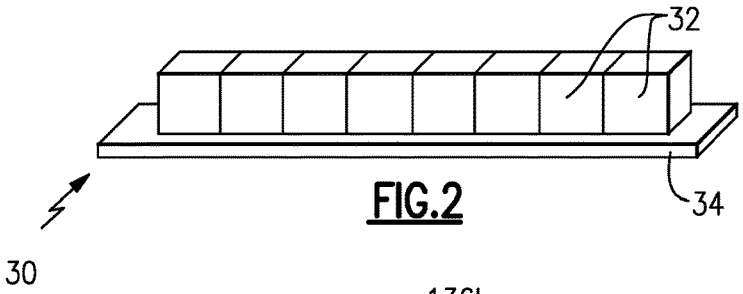
FIG. 2 illustrates an example of a flexible fragment strand that has a single file line arrangement of discrete fragments.

FIG. 2 shows an example of a flexible fragment strand 30 (hereafter "strand 30") that may be used in the method 20. As used herein, a "strand" is a unitary continuous patterned or structured elongated element that can, for example, be preformed in a winding operation in preparation for manufacture. The strand 30 includes a plurality of discrete fragments 32 that are arranged in a desired pattern. A flexible media 34 holds the discrete fragments together in the pattern such that the strand 30 can be applied to the core piece in the method 20. For example, the flexible media 34 can be a flexible strip, such as but not limited to, a polymer, metal, or an energetic material. The flexible media 34 should generally be strong enough to remain intact during processing in the method 20.

The size and shape of the discrete fragments 32, as well as the pattern in which the discrete fragments 32 are provided, may be varied to tailor the configuration of the resulting fragmentation wrap in the method 20 for enhanced fragment packing and/or controlled explosive dispersion. In the illustrated example, the discrete fragments 32 are cubic. In modified examples, the discrete fragments are rectangular, pyramidal, spherical, other geometric shape, or combinations thereof. In the illustrated example, the discrete fragments 32 have a common size and geometry. The material composition of which the discrete fragments 32 are formed of is not particularly limited and may be, but is not limited to, metals and alloys, especially high density metals or alloys such as tungsten and tantalum, reactive materials, and ceramic materials.

The discrete fragments 32 are arranged in a single file line arrangement on the flexible media 34. The discrete fragments 32 may be bonded to the flexible media 34, such as by adhesive bonding, weld bonding, or diffusion bonding. The discrete fragments 32 may be encased by the flexible media 34. In one embodiment the flexible media 34 may be a tube encasing the discrete fragments 32, akin to a heat shrink wrap.

Figure 3:
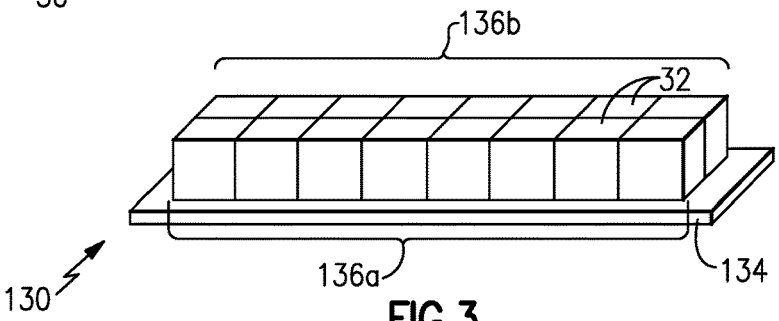
FIG. 3 illustrates an example of a flexible fragment strand that has multiple rows of discrete fragments.

FIG. 3 shows another example flexible fragment strand 130 that can be used in the method 20. In this disclosure, like reference numerals designate like elements where appropriate and reference numerals with the addition of one-hundred or multiples thereof designate modified elements that are understood to incorporate the same features and benefits of the corresponding elements. Here, the discrete fragments 32 are arranged in a pattern that has two or more elongated rows **136*a*/136*b* that run adjacent to each other. The flexible media 134 holds the discrete fragments 32** in the pattern.

Figure 4:
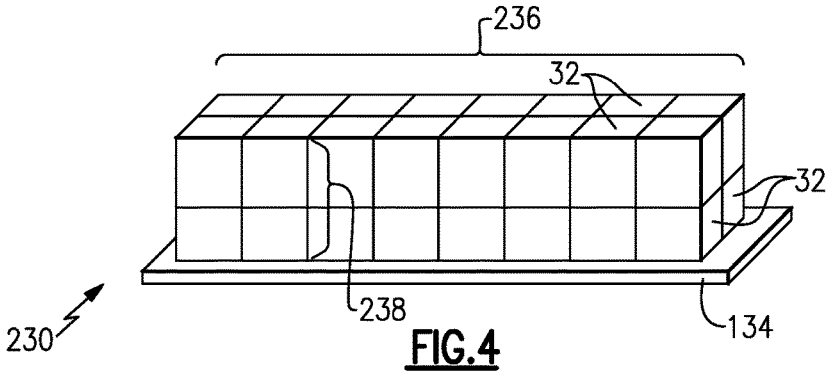
FIG. 4 illustrates an example of a flexible fragment strand that has multiple rows and columns of discrete fragments.

FIG. 4 shows another example flexible fragment strand 230 that can be used in the method 20. Here, the discrete fragments 32 are arranged in a pattern that has multiple elongated rows 236 that run adjacent to each other and multiple columns 238. The flexible media 134 holds the discrete fragments 32 in the pattern.

Figure 5:
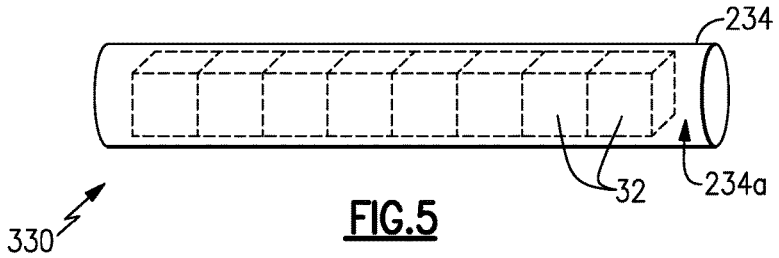
FIG. 5 illustrates an example of a flexible fragment strand that has discrete fragments held in a flexible sleeve.

FIG. 5 shows another example flexible fragment strand 330 that can be used in the method 20. Here, the flexible media 234 is a flexible sleeve **234*a* that circumscribes or encapsulates the discrete fragments 32 and holds the discrete fragments in the pattern. Because the flexible sleeve 234*a* circumscribes or encapsulates the discrete fragments 32, the discrete fragments 32 need not be bonded to the flexible media 234. However, if greater holding of the discrete fragments 32 is desired, bonding may be used. In this embodiment, the fragments 32 may be cast or coextruded into the media 234**.

In another embodiment, the flexible media 234 may have matching geometric features that provide for an interference fit or a friction fit with the discrete fragments 32. In another embodiment, the flexible media 234 may have magnetics that provide for holding fast the discrete fragments in a predetermined pattern.

The flexible sleeve **234*a* may be a metal or polymer sheet that is wrapped around the discrete fragments 32 or a metal or polymer tubular structure, such as a fibrous web, that is disposed about the discrete fragments 32 either during or after the arranging of the discrete fragments 32** into the desired pattern.

Figure 6:
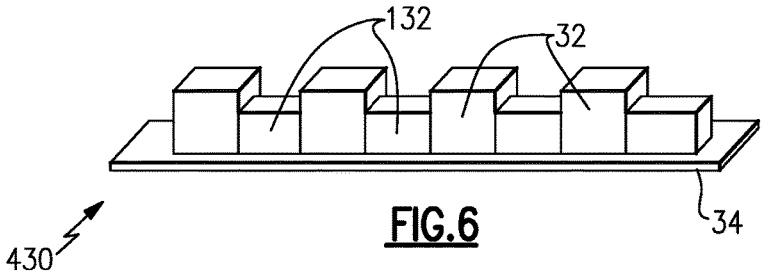
FIG. 6 illustrates an example of a flexible fragment strand that has discrete fragments of dissimilar geometric shapes.

FIG. 6 shows another example flexible fragment strand 430 that can be used in the method 20. Here, the discrete fragments 32 have a common size. The discrete fragments 32 are arranged in a pattern with discrete fragments 132 that have a different common size. Thus, the discrete fragments 32/132 have dissimilar geometric shapes. Although shown in rectangular forms, one or both of the discrete fragments 32/132 could alternatively have a different geometric shape. In a further example, one or more additional different common size fragments could be used in the pattern with the fragments 32/132. In any of the examples herein, although the fragments 32/132 may be shown side-by-side, the fragments 32/132 may be spaced apart or may include interruptions between fragments 32/132, i.e., "blank" fragment spaces.

Figure 7:
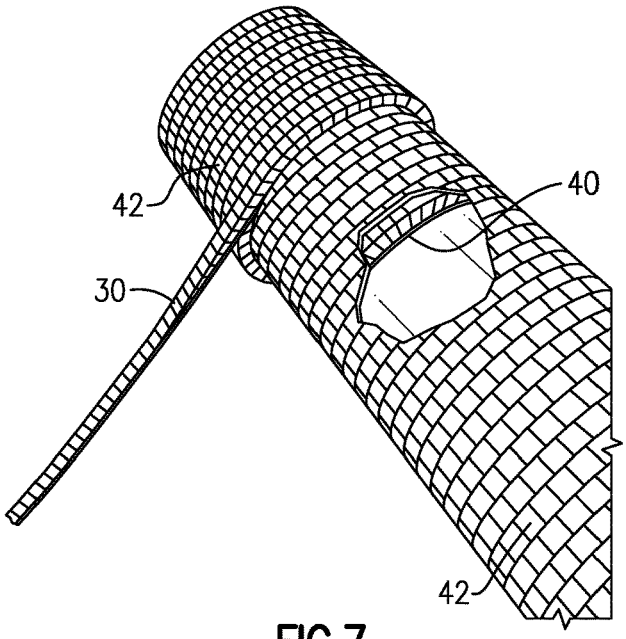
FIG. 7 illustrates an example of a flexible fragment strand being wound onto a core piece.

As shown by the examples herein, the flexible fragment strand 30/130/230/330/430 can be tailored in fragment size, fragment geometry, fragment retention method, and fragment pattern in order to tailor the configuration of the fragment layer produced in the method 20. For example, FIG. 7 depicts an example of applying the flexible fragment strand 30 at step 24 onto a core piece 40. In this example, the flexible fragment strand 30 is wound onto the core piece 40 to produce one or more fragment wraps 42. A plurality of wraps 42 may be used to at least partially cover the core piece 40 or to produce one or more layers that at least partially cover the core piece 40. As can be appreciated, the winding process can also be tailored in combination with tailoring the flexible fragment strand 30/130/230/330/430 to control the configuration of the fragment wraps 42. For instance, multiple fragment strands 30/130/230/330/430 could be co-wrapped simultaneously, side-by-side, onto the core piece 40 to produce a desired configuration. The fragment wrap 42 may surround or cover a portion of the core piece 40 or the entire core piece 40. In one embodiment, a partial covering may be spiral wound with the core piece 40 exposed between circumferential wraps of the strand 30. In another embodiment, the core piece 40 may be exposed at one axial end or along a length proximate the axial end. By tailoring the pattern of the fragment wraps 42, the impact of the fragments 32/132 may be predetermined for a given mission.

Figure 8:
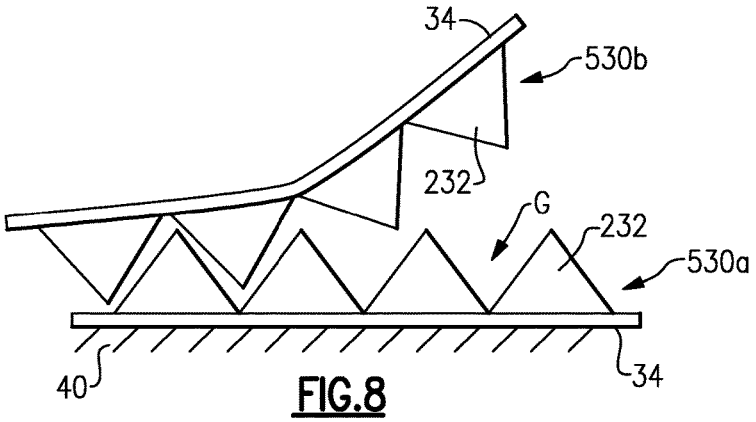
FIG. 8 illustrates an example of congruent flexible fragment strands.

In a further example shown in FIG. 8, a first flexible fragment strand **530*a* is applied (e.g., by wrapping) onto the core piece 40, followed by applying (e.g., by wrapping) a second, flexible fragment strand 530***b* on the first flexible fragment strand 530*a*. As an example, the flexible fragment strands 530*a*/530*b* can be simultaneously wrapped, but with the second flexible fragment strand 530*b* trailing the first flexible fragment strand 530*a* in the winding direction. For instance, each strand 530*a*/530*b* has discrete fragments 232 that are matching and that may interfit, partially interfit, align, partially align, mate, or partially mate with each other. In some examples, when the first flexible fragment strand 530*a* is applied, there are controlled geometry gaps, G, between the discrete fragments 232. The second flexible fragment strand 530*b*, which may be the same or different configuration than the first flexible fragment strand 530*a*, is inverted and applied over the first flexible fragment strand 530*a* such that the discrete fragments 232 of the second flexible fragment strand 530*b* fit congruently (fully or partially) into the gaps G.

After applying the flexible fragment strand 30/130/230/330/430 onto the core piece 40, the core piece 40 may or may not be removed. For instance, the core piece 40 may be a liner or casing of the fragmentation structure. In this regard, the core piece 40 may have a cylindrical geometry, a conical geometry, another axisymmetric geometry, or a non-axisymmetric geometry. Alternatively, the core piece 40 may be a mandrel that is removed at some point after the application of the flexible fragment strand 30/130/230/330/430.

In a further example, the method 20 may also include potting the discrete fragments 32/132/232 to bond and hold the discrete fragments 32/132/232 in the fragment wrap 42. For instance, a potting material is introduced into the interstices between the discrete fragments 32/132/232 in the fragment wrap 42. The potting material is not particularly limited and may include, but is not limited to, polymer materials, energetic materials, metal materials, ceramic materials, and combinations thereof. In one example, the potting material is introduced by transfer molding.

Figure 9:
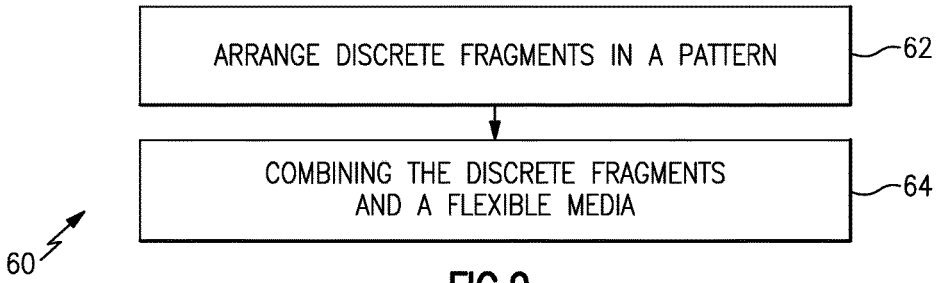
FIG. 9 illustrates an example method of forming a fragment strand for at least one fragment wrap of a fragmentation structure.

As mentioned above, the flexible fragment strand 30/130/230/330/430 can be fabricated from initially separate starting materials. FIG. 9 illustrates an example method 60 for forming a flexible fragment strand 30/130/230/330/430. The method 60 includes step 62 of arranging the discrete fragments 32/132/232 in a pattern, and step 64 of combining the flexible media 34/134/234 and the discrete fragments 32/132/232. The flexible media 34/134/234 holds the discrete fragments 32/132/232 together in the pattern. The combining of the flexible media 34/134/234 and the discrete fragments 32/132/232 may include applying the flexible media 34/134/234 to the individual or patterned discrete fragments 32/132/232, or applying the discrete fragments 32/132/232 individually or in a pattern to the flexible media 34/134/234.

The discrete fragments 32/132/232 can be arranged into the desired pattern manually or in an automated or semi-automated manner. The arranging of the discrete fragments 32/132/232 in step 62 can include orienting the discrete fragments 32/132/232 and placing the discrete fragments 32/132/232 into alignment in the pattern. For example, orienting the discrete fragments 32/132/232 may include identifying a common face on an initially loose one of the discrete fragments 32/132/232 and then placing that discrete fragment 32/132/232 into a position in the pattern such that the common face faces in a common direction with the common faces of the other discrete fragments 32/132/232 in the pattern.

The combining of the flexible media 34/134/234 and the discrete fragments 32/132/232 at step 64 may include bringing the flexible media 34/134/234 into contact with or into proximity of the discrete fragments 32/132/232, or vice versa. For adhesive bonding, an adhesive may be pre-applied to the discrete fragments 32/132/232, the flexible media 34/134/234, or both. For weld or diffusion bonding the flexible media 34/134/234 and/or discrete fragments 32/132/232 may be heated to form a weld or diffusion bond. For the flexible sleeve 234*a*, the discrete fragments 32/132/232 may be placed into the flexible sleeve 234*a*, which may or may not be a heat shrinkable material. For instance, the discrete fragments 32/132/232 may be cast or co-extruded into the flexible sleeve 234*a*. Casting may include forming the discrete fragments 32/132/232 into the flexible sleeve 234*a* or prefabricating the discrete fragments 32/132/232 followed by dry loading the fragments 32/132/232 into the flexible sleeve 234*a*. In a further example, the flexible sleeve 234*a* is a heat shrink tube and, after loading, the tube is heated to shrink around the fragments 32/132/232. Placement of the fragments 32/132/232 into the flexible sleeve 234*a* may include aligning the discrete fragments 32/132/232 in the flexible sleeve 234*a* to form the desired pattern. In another example, the flexible sleeve 234*a* is applied to the discrete fragments 32/132/232 by extruding the flexible sleeve 234*a* around the discrete fragments 32/132/232.

Although a combination of features is shown in the illustrated examples, not all of them need to be combined to realize the benefits of various embodiments of this disclosure. In other words, a system designed according to an embodiment of this disclosure will not necessarily include all of the features shown in any one of the Figures or all of the portions schematically shown in the Figures. Moreover, selected features of one example embodiment may be combined with selected features of other example embodiments.

The preceding description is exemplary rather than limiting in nature. Variations and modifications to the disclosed examples may become apparent to those skilled in the art that do not necessarily depart from this disclosure. The scope of legal protection given to this disclosure can only be determined by studying the following claims.

What is claimed is:

1. A method comprising:

forming at least one fragment wrap for a fragmentation structure by, providing at least one flexible fragment strand that includes a plurality of discrete fragments held together in a pattern by a flexible media, and applying the at least one flexible fragment strand around a core piece to form the at least one fragment wrap, wherein the applying the at least one flexible fragment strand includes applying a first flexible fragment strand around the core piece followed by applying a second flexible fragment strand on the first flexible fragment strand.

2. The method of claim 1, wherein the fragment wrap partially covers the core piece.

3. The method of claim 1, wherein the fragment wrap fully covers the core piece.

4. The method of claim 1, wherein the second flexible fragment strand fits partially or fully congruently with the first flexible fragment strand.

5. The method as recited in claim 1, wherein the flexible media encapsulates the fragments.

6. The method as recited in claim 1, wherein the discrete fragments are bonded to the flexible media.

7. The method as recited in claim 1, wherein the pa is a single file line arrangement of the discrete fragments.

8. The method as recited in claim 1, wherein the pattern comprises multiple elongated rows of the discrete fragments.

9. The method as recited in claim 8, wherein the pattern comprises multiple columns of the discrete fragments.

10. The method as recited in claim 1, wherein the flexible media comprises a flexible sleeve that circumscribes the discrete fragments.

11. The method as recited in claim 1, further comprising applying a potting material to the at least one fragment wrap.

12. The method as recited in claim 1, herein the discrete fragments comprise dissimilar geometric shapes.

13. A method comprising:

forming at least one fragment wrap for a fragmentation structure by, providing at least one flexible fragment strand that includes a plurality of discrete fragments held together in a pattern by a flexible media, and applying the at least one flexible fragment strand around a core piece to form the at least one fragment wrap, wherein the applying of the at least one flexible fragment strand includes winding the flexible fragment strand around the core piece, further comprising applying a plurality of flexible fragment strands around the core piece simultaneously.

14. A method comprising: forming a fragment strand for at least one fragment wrap of a fragmentation structure by, arranging a plurality of discrete fragments in a pattern, wherein the pattern is a single file line, and combining the discrete fragments and a flexible media, wherein the media is a strip, the flexible media holding the discrete fragments together in the pattern, and winding the flexible media around a core piece to form the fragmentation structure.

15. The method as recited in claim 14, wherein the combining includes applying the flexible media to the discrete fragments.

16. The method as recited in claim 14, wherein the arranging includes arranging the discrete fragments into at least one elongated row.

17. The method as recited in claim 16, wherein the arranging includes arranging the discrete fragments into multiple columns.

18. The method as recited in claim 14, wherein the flexible media comprises a flexible sleeve, and the applying includes placing the discrete fragments into the flexible sleeve.

* * * * *